US005594301A

United States Patent [19]

Sawai et al.

[11] Patent Number: 5,594,301

[45] Date of Patent: Jan. 14, 1997

[54] ELECTRON TUBE INCLUDING ALUMINUM SEAL RING

[75] Inventors: Toshihiko Sawai; Masayuki Inuzuka; Toyohiko Terada, all of Hamamatsu, Japan

[73] Assignee: Hamamatsu Photonics K.K., Hamamatsu, Japan

[21] Appl. No.: 589,576

[22] Filed: Jan. 22, 1996

Related U.S. Application Data

[63] Continuation of Ser. No. 268,944, Jun. 30, 1994, abandoned.

[51] Int. Cl.[6] ..... H01J 40/02

[52] U.S. Cl. ..... 313/523; 313/532; 313/103 R

[58] Field of Search ..... 313/523, 532, 313/533, 534, 535, 103 R; 220/2.1 R, 2.2, 2.3 R

[56] References Cited

U.S. PATENT DOCUMENTS

| | | | |
|---|---|---|---|
| 3,555,333 | 1/1971 | Yarmovsky | 313/103 |
| 3,662,206 | 5/1972 | Fleck | 313/544 |
| 3,754,674 | 8/1973 | Wesoloski | 220/2.3 R |
| 3,865,567 | 2/1975 | Klomp | 65/43 |
| 4,306,171 | 12/1981 | Faulkner et al. | 313/533 |
| 4,376,246 | 3/1983 | Butterwick | 313/533 |
| 4,721,884 | 1/1988 | Colomb et al. | 313/523 |
| 4,777,403 | 10/1988 | Stephenson | 313/533 |
| 4,788,382 | 11/1988 | Ahearn et al. | 174/52 FP |
| 4,870,473 | 9/1989 | Sugimori | 313/544 |
| 4,871,943 | 10/1989 | Eschard | 313/526 |
| 4,914,349 | 4/1990 | Matsui et al. | 313/532 |
| 5,051,572 | 9/1991 | Joseph et al. | 313/534 |
| 5,218,264 | 6/1993 | Hirai et al. | 313/544 |
| 5,498,926 | 3/1996 | Kyushima et al. | 313/533 |

FOREIGN PATENT DOCUMENTS

| | | | |
|---|---|---|---|
| 57-9648 | 2/1982 | Japan | H01J 9/26 |

*Primary Examiner*—Michael Horabik
*Assistant Examiner*—Michael Day
*Attorney, Agent, or Firm*—Cushman Darby & Cushman IP Group of Pillsbury Madison & Sutro, LLP

[57] ABSTRACT

An electron tube, such as, a photomultiplier, includes an aluminum seal ring 4 disposed between a Kovar cylinder 1, and a quartz faceplate 5 having a photocathode 6. The electron tube further includes a borosilicate stem plate 2, an anode 8, and a dynode 7. The aluminum seal ring 4 provides for increased air tightness, reliability, quantum efficiency, and gain.

6 Claims, 6 Drawing Sheets

ELECTRON TUBE INCLUDING ALUMINUM SEAL RING

This is a continuation of application Ser. No. 08/268,944, filed on Jun. 30, 1994, which was abandoned upon the filing hereof.

BACKGROUND OF THE INVENTION

1. Field of the invention

The present invention relates to an electron tube, e.g., a photomultiplier, image intensifier or streak camera.

2. Related Background Art

An electron tube having a photoelectric surface (photoemissive cathode) is constituted to include a light-receiving surface plate, a cylinder, and a stem member. Borosilicate glass or the like is used as the material of the stem member so that external terminals (pin members) extend through the stem member. A glass plate is often used as the light-receiving surface plate. Therefore, the cylinder and the light-receiving surface plate must be adhered.

A conventional method for sealing the cylinder with the light-receiving surface plate without using heat treatment, that is a so called cold seal method, is described in Japanese Patent Publication No. 9648/1982.

SUMMARY OF THE INVENTION

The electron tube according to present invention will improve the airtightness and quantum efficiency, and will decrease the entire size and cost thereof.

An electron tube having light-receiving surface plate made of glass and a metal cylinder sealed from each other by using In (indium) may be considered. In this case, to shorten the cylinder, considering matching with the stem member, the Kovar metal may be preferably used as the material of the metal cylinder.

When a Kovar cylinder and a quartz plate are sealed from each other by using In, the airtightness after formation of the photoemissive cathode layer is not sufficient for detecting weak light with high sensitivity, or the seal portion In may be deformed. This is because the temperature must be set to 200° to 300° C. in the manufacture of a photoemissive cathode although In is softened at a comparatively low temperature (156° C.).

On the other hand, when a borosilicate glass cylinder and a quartz light-receiving surface plate are adhered by using glass having an intermediate thermal expansion coefficient between those of borosilicate glass and quartz, it is difficult to decrease the entire size of the electron tube. Also, the cost may be increased due to the difficult process.

The present invention has been made to overcome the above problem, and has as its object to provide a small electron tube capable of sealing with excellent airtightness.

An electron tube according to the present invention is characterized in that a quartz light-receiving surface plate having a photoelectric surface formed on an inner surface thereof and a cylinder forming a side wall of a vacuum vessel are thermally contact-bonded through an aluminum ring.

The electron tube according to the present invention comprises a plate based on glass having inner surface and outer surface, wherein the inner surface is coated with photoemissive cathode layer; a vessel having a cylinder attached to the plate; a seal ring made of a material including aluminum as a main component, arranged between the plate and cylinder; a pin extending through the vessel, wherein the pin is electrically connected to the photoemissive cathode layer.

According to the present invention, since sealing is done by using aluminum having a high melting point, even if the structure is heated during formation of the photoelectric surface, the seal portion will not be deformed, or the reliability of the airtightness will be improved and not be degraded. The aluminum seal ring made of a material including aluminum as a main component is not softened at the manufacturing temperature of the photoemissive cathode and is softened at about a temperature of 470° C., which is higher than the manufacturing temperature. Also, deformation, stress, and the like caused by a difference in thermal expansion coefficients between the light-receiving surface plate and the cylinder are absorbed.

Especially, electron tube according to the present invention is further improved when the cylinder is made of Kovar. Mechanical strength per unit area of the cylinder made of Kovar is higher than that of glass, and entire size of the electron tube is may be decreased by using Kovar. Further, Kovar has a good adhesion with aluminum.

The aluminum seal ring, which has a diameter in a range from ⅜ to 5 inches, a thickness in a range from 0.15×Rt to 2.0×Rt mm, and a width in a range from 0.33×Rt to 1.67×Rt mm, is effective in the view of airtightness thereof, where Rt is a thickness of a side wall of the cylinder.

More precisely, the Aluminum seal ring, which has a diameter in a range from ⅜ to 5 inches, a thickness in a range from 0.26×Rt to 0.33×Rt mm, and a width in a range from 0.67×Rt to 1.0×Rt mm, is more effective in view of airtightness and quantum efficiency, where Rt is a thickness of a side wall of the cylinder.

In the view of mechanical strength of the electron tube, the thickness Rt mm is thicker than a value of 1 mm plus one seventy-sixth of an outer diameter of the cylinder.

Air tightness and mechanical strength of the electron tube are further improved when one portion of the cylinder facing to said plate curves toward inside of said cylinder. In this case, the cylinder made of Kovar is preferable.

The vessel of the electron tube comprises a stem plate fixed to said cylinder. Since the stem plate is made of borosilicated glass which has a lower melting temperature than quartz glass, the stem plate easily melts by applying high frequency waves or electron waves to the stem plate. Therefore, the stem plate is easily fixed to the cylinder and the present technique lowers the cost of fabricating the electron tube.

One portion of the cylinder facing the stem plate curves toward the outside of the cylinder. Therefore, touch area and adhesion of the cylinder with the stem plate is increased. Since the portion of the cylinder extends in an outward direction, this structure prevent the cylinder from coming off the stem plate when the cylinder is pressed. When one portion of the cylinder facing the light-receiving plate curves towards the inside of the cylinder, adhesion of the cylinder with the stem plate is increased. The adhesion is improved when the cylinder has a cylindrical shape.

The electron tube according to present invention further comprises an anode arranged in the vessel; a dynode arranged between the photoemissive cathode and the anode; and a pin electrically connected to the anode.

Two pins respectively connected to the photoemissive cathode and anode are applied with different voltages.

Electrons emitted from the photoemissive cathode are collected at the anode.

The electron tube further comprises an ultimate dynode arranged so that the anode is located between the dynode and the ultimate dynode. The ultimate dynode operates for shielding the anode and increasing quantum efficiency by reflecting electrons passed through the anode, to the anode.

The electron tube mentioned above is, for example, fabricated as follows: The electron tube includes a stem plate, a cylinder fixed to the stem plate, a plate having an inner surface covered with photoemissive cathode layer and fixed to the cylinder, and a seal ring made of a material including aluminum as a main component interposed between the cylinder and the plate.

A method for fabricating the electron tube, comprises a step of arranging the aluminum seal ring between the plate and the cylinder; a step of pressing on the aluminum seal ring, while the aluminum seal ring is heated, to fix the plate to the cylinder; and a step of applying high-frequency waves to the stem plate in contact with the cylinder to fix the stem plate to the cylinder. In the step of pressing on the aluminum ring, the aluminum seal ring is pressed until the aluminum seal ring has a diameter in a range from ⅜ to 5 inches, a thickness in a range from 0.26×Rt to 0.33×Rt mm, and a width in a range from 0.67×Rt to 1.0×Rt mm, where Rt is a thickness of a side wall of the cylinder. The thickness Rt mm is thicker than a value of 1 mm plus one seventy-sixth of the outer diameter of the cylinder.

As has been described above, in the electron tube according to the present invention, since sealing is done by using aluminum having a high melting point, even if the structure is heated during formation of the photoelectric surface, the seal portion will not be deformed, or the reliability of the airtightness will not be degraded. Also, deformation, stress, and the like caused by a difference in thermal expansion coefficients are absorbed. As a result, a small, high-reliability, and low-cost electron tube can be realized.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

BRIEF DESCRIPTION OF THE DRAWINGS

In the accompanying drawings.

DETAIL DESCRIPTION OF THE PREFERRED EMBODIMENTS

Figure 1:
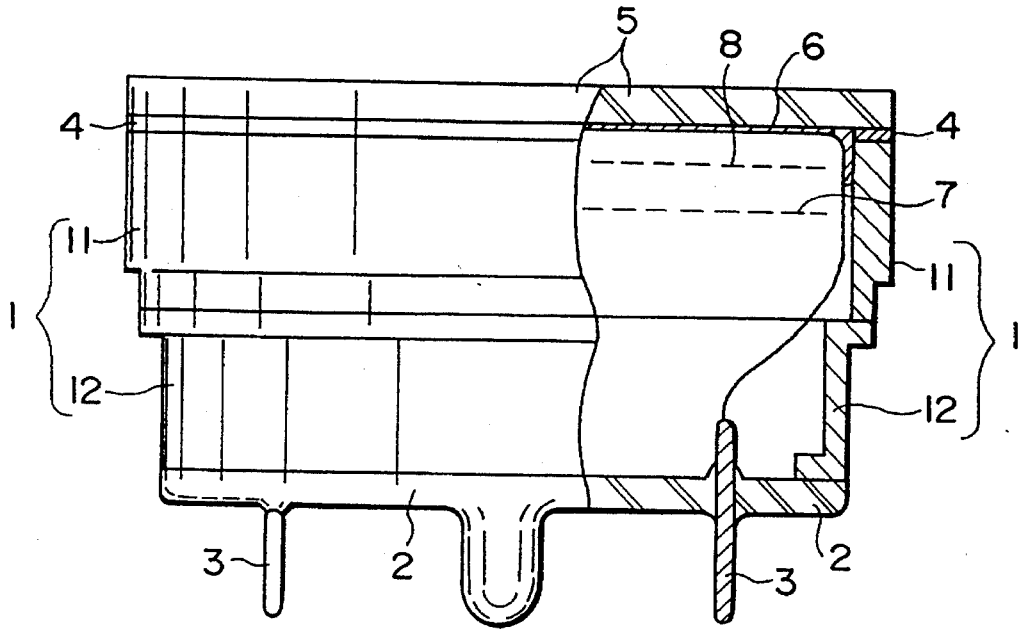
FIG. 1 is a partially cutaway view showing the arrangement of a photomultiplier according to an embodiment of the present invention.

A photomultiplier according to an embodiment of the present invention will be described with reference to the accompanying drawings. It is noted throughout the description hereinbelow that identical reference numerals are used to denote identical parts, the term "upper" and "lower" should be referred to the orientation in the drawings.

The photomultiplier according to this embodiment has a so-called reflection type dynode and is arranged as shown in the partially cutaway view of FIG. 1. As shown in FIG. 1, a cylinder 1 made of a Kovar (KOV) metal is constituted by upper and lower cylinders 11 and 12 that are integrally formed. A stem plate 2 made of borosilicate glass is fixed to the opening in the lower surface of the lower cylinder 12, and pins (external terminals) 3 extend through the stem plate 3.

A quartz light-receiving surface plate 5 is thermally contact-bonded to the opening in the upper surface of the upper cylinder through an aluminum seal ring 4. A photoemissive cathode layer 6 made of, e.g., an alkali metal, is formed on the inner surface of the light-receiving surface plate 5, and a dynode 7 and an anode 8 connected to the pins 3 are provided in the upper cylinder 11.

The operation of the above photomultiplier will be briefly described. When measurement light is incident on the photoemissive cathode layer 6 through the light-receiving surface plate 5, photoelectrons corresponding to the incident light are emitted in the vacuum in the photomultiplier. The photoelectrons are accelerated to collide against the dynode 7 so that a large amount of secondary electrons are emitted. The secondary electrons are detected by the anode 8 and output to the outside through the pins 3.

Figure 2:
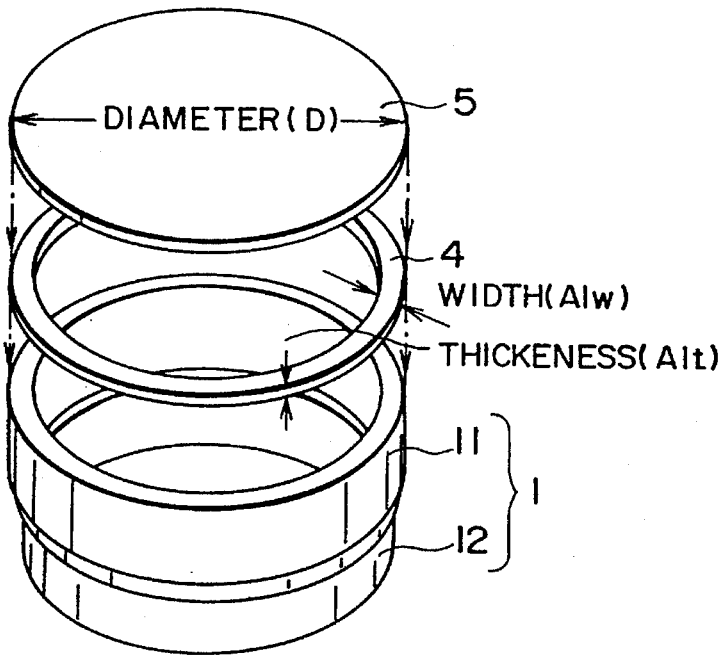
FIG. 2 is a perspective view showing the arrangement of an aluminum seal ring depicted in FIG. 1.
Figure 3:
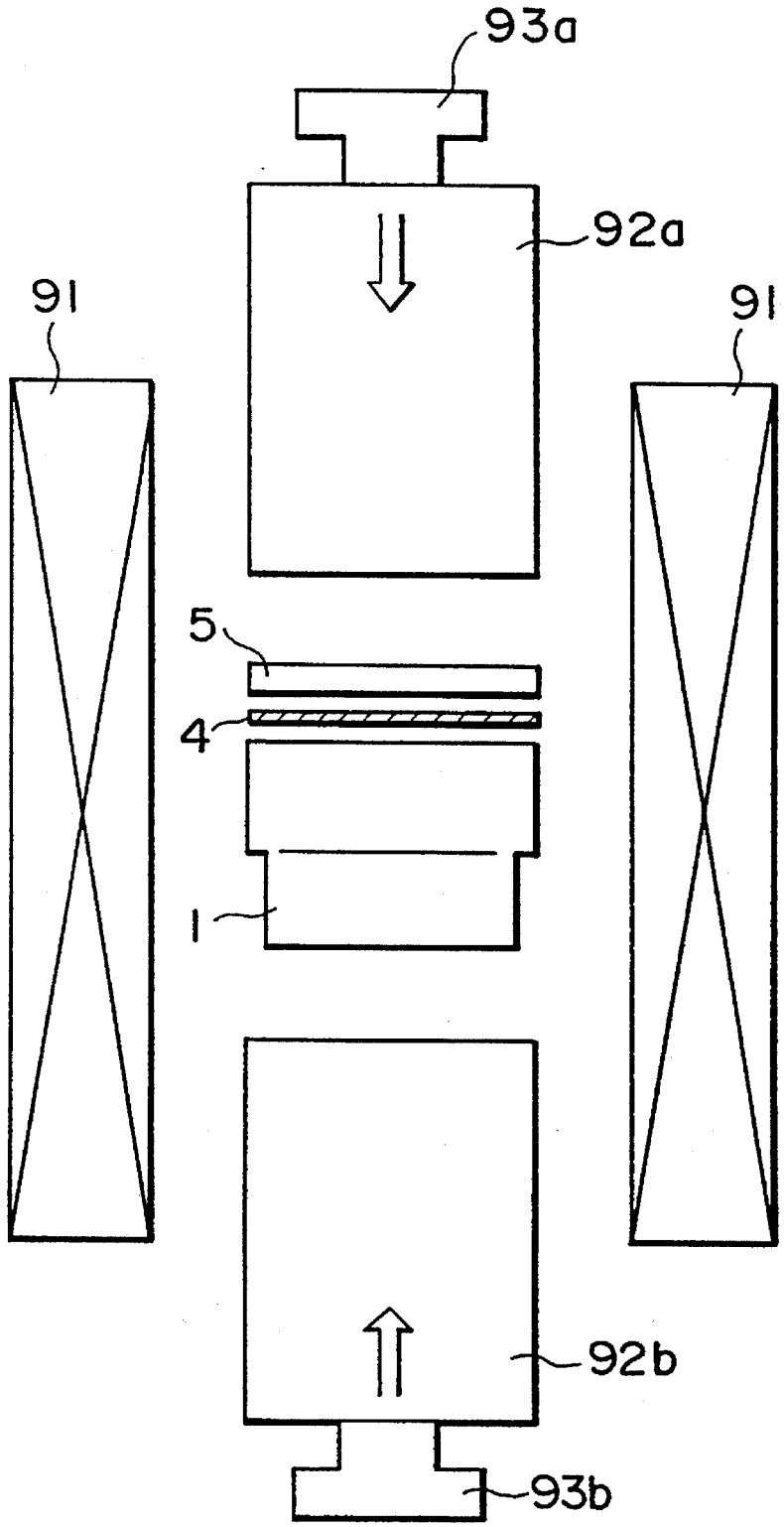
FIG. 3 is an explanatory diagram of a manufacturing system of the photomultiplier according to the embodiment of the present invention.

Thermal contact bonding by using the seal ring 4 in the above embodiment is performed as shown in FIGS. 2 and FIG. 3. The upper cylinder 11 and the light-receiving surface plate 5 are prepared, and the seal ring 4 is interposed between them (see FIG. 2). The resultant structure is set in a thermal contact bonding system, as shown in FIG. 3. The thermal contact bonding system has an electric furnace 91, a pair of pressing jigs **92*a* and 92*b*, and a pair of pressing mechanisms 93*a* and 93*b* connected to the pressing jigs 92*a* and 92*b***.

In the thermal contact bonding process, the structure is heated from room temperature to 470° C. and held at this temperature for about 25 minutes. Subsequently, the structure is pressed at a pressure of about 2 kg/cm$^2$ while sandwiching the seal ring 4 and held at this state for about 25 minutes. Thereafter, the pressure is gradually decreased, and the structure is cooled down to a temperature near room temperature.

In order to confirm the usefulness of the present invention, the present inventors manufactured the following sample. The outer diameter and length of the photomultiplier were set to 1.5 inches and 20 mm, respectively. This length is about 50% the normal size, thus achieving sufficient downsizing. The temperature and pressure condition for performing sealing were set to the same as those described above. Upper and lower cylinders 11 and 12 were adhered in accordance with plasma arc welding. A K-Cs-Te triode type photoelectric surface was formed.

The quantum efficiency and gain of the above sample were measured. A quantum efficiency of about 1.3 times the normal value and a gain of about twice the normal value were obtained.

When the upper cylinder 11 is based on kovar metal and the thickness of the aluminum seal ring 4 is too thin, the difference of the thermal coefficients of the upper cylinder 11 and aluminum seal ring 4 causes the aluminum seal ring 4 to come off the upper cylinder 11.

When the thickness ($Al_t$) of the aluminum seal ring 4 is too thick, since the upper cylinder 11 must be pressed with stronger force to contact bond with the aluminum seal ring 4 and the light receiving surface plate 5, the force causes the upper cylinder 11 to be deformed.

When the width ($Al_W$) of the aluminum seal ring in a direction of radius vector of the aluminum seal ring 4 is too narrow, airtightness of the photomultiplier is not sufficient. When the width ($Al_W$) in a direction of radius vector of the aluminum seal ring 4 is too broad, since the seal ring 4 crosses with the photoemissive cathode layer 6, quantum efficiency of the photomultiplier becomes worse. Therefore, there are preferable thicknesses and widths of the photoemissive cathode layer 6 in predetermined ranges.

The thickness of the aluminum seal ring 4 has a strong relation to the width ($Al_W$), thickness(Rt) of the side wall of the upper cylinder 11 and diameter (D) of the upper cylinder 11.

When the cylinder 11 has the outer diameter(D) in a range from ⅜ to 5 inches, and the thickness($Al_t$) of the aluminum seal ring 4 is in a range from 0.15×x Rt(mm) to 2.0×Rt and the width($Al_W$) in a direction of radius vector of the aluminum seal ring 4 is in a range from 0.33×Rt to 1.67×Rt(mm), the mechanical strength of the electron tube and bond strength is increased. Rt is a thickness of the side wall of the upper cylinder 11.

In the view of adhesion of the aluminum seal ring 4 with the upper cylinder 11, the aluminum seal ring 4 has a preferable shape as follows: The outer diameter(D) of the upper cylinder 11 is in a range from ⅜ to 5 inches, the thickness ($Al_t$) of the aluminum seal ring 4 is in a range from 0.26×Rt to 0.33×Rt(mm) and width ($Al_W$) in a direction of radius vector of the aluminum seal ring 4 is in a range from 0.67×Rt to 1.0×Rt(mm).

Preferable thickness of the side wall of the upper cylinder 11 with sufficient strength is thicker than 1 mm plus one seventy-sixth of the outer diameter. The stem plate 3 shown in FIG. 1 is attached to the lower cylinder 12 by a method illustrated in FIG. 4 and FIG. 5.

Figure 4:
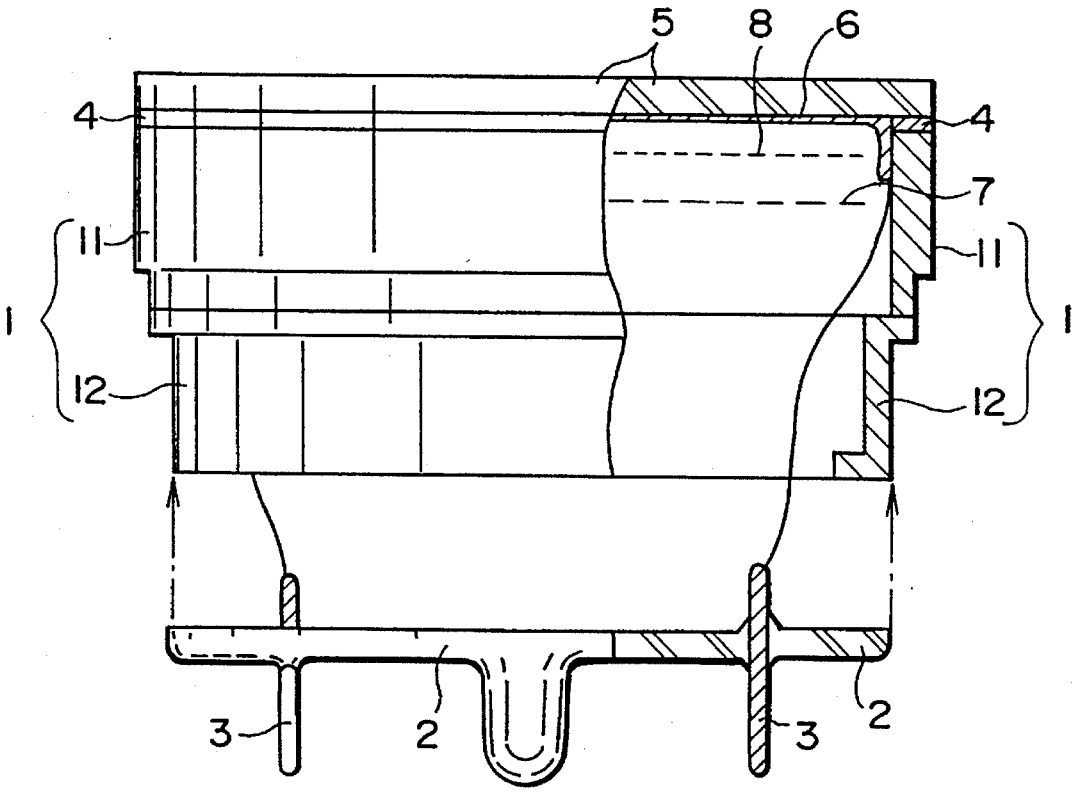
FIG. 4 is a partially cutaway view of the photomultiplier according to an embodiment of the present invention.
Figure 5:
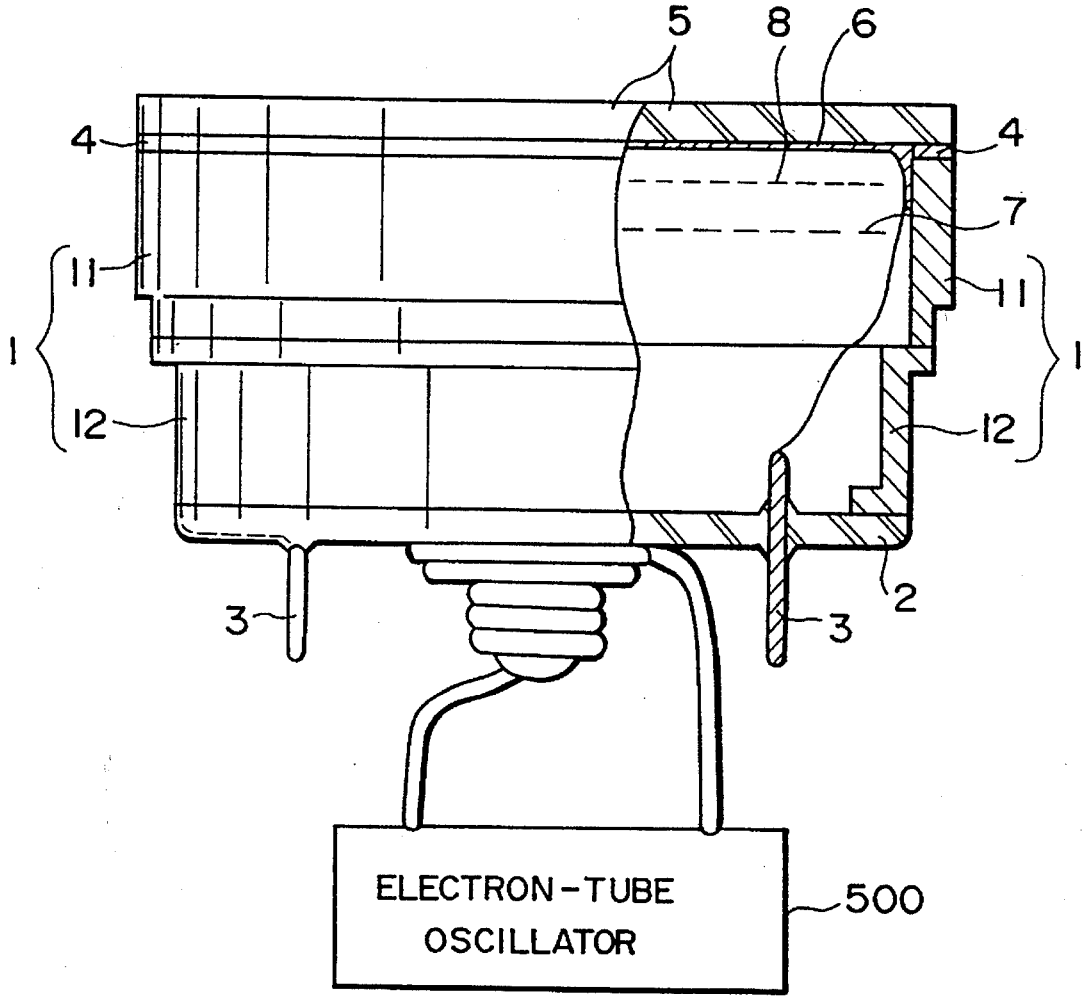
FIG. 5 is a partially cutaway view of the photomultiplier according to an embodiment of the present invention, and illustrating a stem plate to which high frequency waves are applied.

First, the stem plate 3 based on borosilicated glass is arranged on the periphery of the opening of the lower cylinder 11 made of kovar(see FIG. 4). Next, high frequency waves are applied to the stem plate 3. The stem plate 3 is heated by applying high frequency waves to the stem plate 3. The stem plate 3 is melted by electronic heating and is fixed to the lower cylinder 11(see FIG. 5). Electronic heating is heating by means of radio-frequency current produced by an electron-tube oscillator 500 or an equivalent radio frequency power source.

Figure 6:
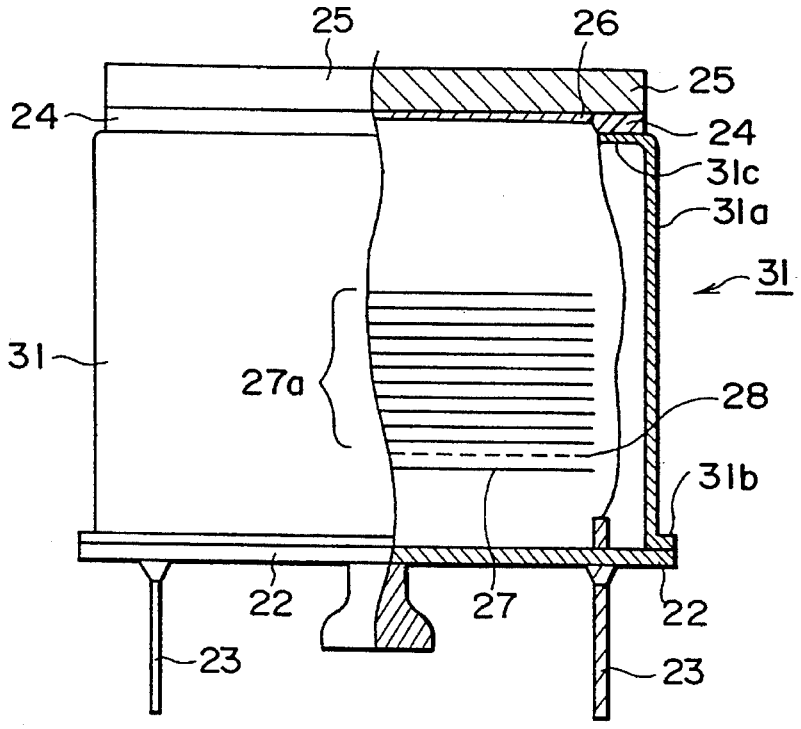
FIG. 6 is a partially cutaway view of the photomultiplier according the present invention.

Next, an electron tube of another embodiment according to present invention will be explained. FIG. 6 shows a partially cutaway view of the electron tube according to the present embodiment, and FIG. 7 shows a plane view of the electron tube depicted in FIG. 6.

The electron tube according to the present invention comprises a light-receiving surface plate 25 made of quartz glass and a cylinder 31 made of Kovar. The light-receiving surface plate 25 is fixed to the cylinder 31. The shape of the cylinder 31 is different from the shape of the cylinder 11 shown in FIG. 1 for increased adhesion with the aluminum seal ring 24.

Figure 7:
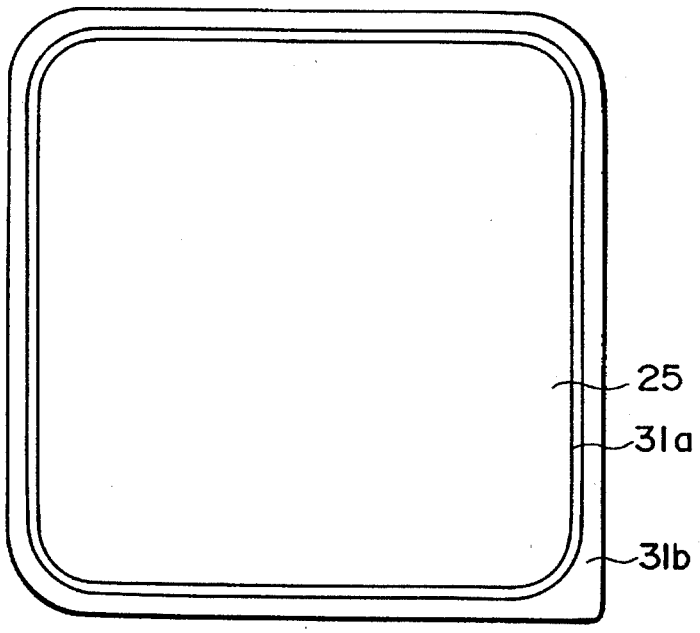
FIG. 7 is a plane view of the photomultiplier depicted in FIG. 6.

As shown in FIG. 6 and FIG. 7, the rectangular shapes cylinder 31 is fixed to the rectangular shape stem plate 22. The stem plate 22 is fixed to periphery of the opening defined by one end portion of the cylinder 31. The stem plate 22 is made of borosilicated glass. Pins 23 of the outer terminal extend through the stem plate 22. First one end portion **31*b* cylinder 31 curves toward the outside of the cylinder 31, and then the second one end portion 31*c* of the cylinder 31 curves toward the inside of the cylinder 31. The portion 31*b* is perpendicular to the portion 31*a*, and the portion 31*c* is also perpendicular to the portion 31*a***.

The first one end portion **31*b* is fixed to the stem plate 22. The second one end potion 31*c* faces the light-receiving surface plate 25, and the aluminum seal ring 24 is inserted between the second one end portion 31*c* and quartz light-receiving surface plate 25. Since the cylinder 31 has second one end potion 31*c* which curves toward the inside of the cylinder 31, touch area of the cylinder 31 with the plate 25 is larger than that of the electron tube shown in FIG. 1. Therefore, the cylinder 31 is fixed to the light-receiving surface plate 25 with stronger force than the electron tube shown in FIG. 1**.

A photoemissive cathode layer or semitransparent photocathode layer 26 is formed on an inner surface of the light-receiving surface plate 25. The preset electron tube has dynodes 27, **27*a* and an anode 28. The dynodes 27, 27*a* and the anode 28 are arranged in the cylinder 31. The dynodes 27, 27*a* and the anode 28 are connected to the pins 23. The dynode 27*a* and the anode 28 are arranged between the final or ultimate dynode 27 and photocathode 26. The dynode 27*a* is arranged between the anode 28 and photocathode 26**.

The operation of the photomulitiplier will be briefly described as follows: When measurement light is incident on the semitransparent photocathode 26 through the light-receiving surface plate 25, photoelectrons corresponding to the incident light are emitted in the vacuum in the photomultiplier. The photoelectrons are accelerated to collide against the dynode **27*a* so that a large amount of secondary electrons are emitted. The secondary electrons are detected by the anode 28 and output to the outside through the pins 23**.

Figure 8:
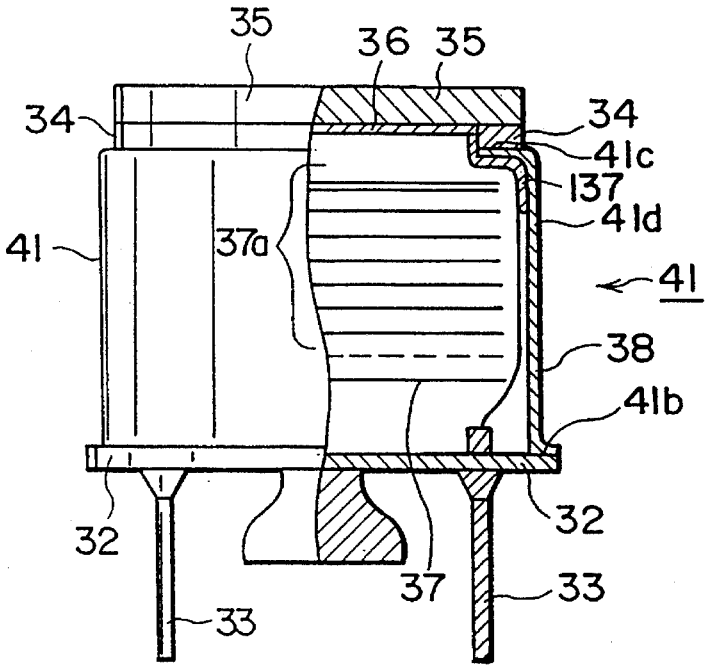
FIG. 8 is a partially cutaway view of the photomultiplier according to the present invention.
Figure 9:
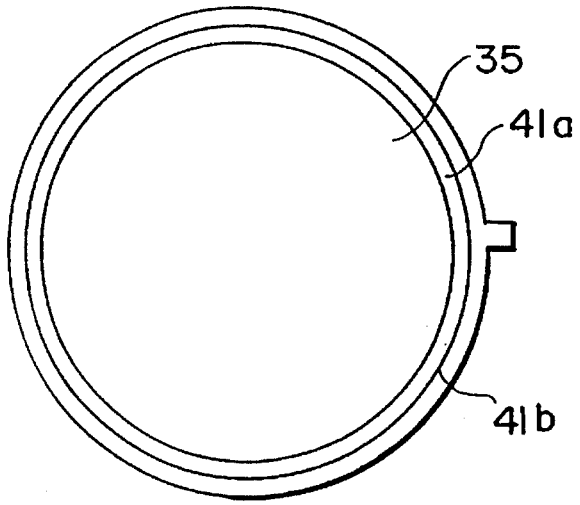
FIG. 9 is a plane view of the photomultiplier depicted in FIG. 8.

FIG. 8 shows a partially cutaway view and FIG. 9 shows a plane view of an electron tube illustrated in FIG. 8. The electron tube is a photomultiplier. The photomultiplier according to present embodiment comprises a light-receiving surface plate 35 made of quartz glass and a cylinder 41 made of Kovar metal. The light-receiving surface plate 35 is fixed to the cylinder 41. The shape of the cylinder 41 is different from the shape of the cylinder 11 or 31 shown in FIG. 1 or FIG. 6 for increasing adhesion strength with aluminum seal ring 34.

As shown in FIG. 8 and FIG. 9, the cylinder 41 is fixed to the circular stem plate 32. The circular stem plate 32 is fixed to the periphery of the opening defined by the lower one end portion 41*b* of the cylinder 41. The circular plate 32 is made of borosilicated glass. A pin 33 outer terminal penetrates the circular plate 32. First one end portion 41*b* of the cylinder 41 curves toward the outside of the cylinder 41, and then a second one end portion 41*c* of the cylinder 41 curves toward the inside of the cylinder 41. The first one end portion 41*b* is fixed to the circular plate 32. The second one end potion 41*c* faces the light-receiving surface plate 35, and the aluminum seal ring 34 is inserted between the second one end portion 41*c* and quartz light-receiving surface plate 35.

Since the cylinder 41 has the second one end potion 41*c* which curves toward inside of the cylinder 41, touch area of the cylinder 41 with the seal ring 34 is larger than that of the electron tube shown in FIG. 1. The cylinder 41 has the shape of a cylinder, therefore, the cylinder 41 is fixed to the light-receiving surface plate 35 with stronger force than the electron tube shown in FIG. 6.

Semitransparent photocathode 36 is formed on an inner surface of the light-receiving surface plate 35. The preset electron tube has dynodes 37, 37*a* and an anode 38. The dynodes 37, 37*a* and the anode 38 are arranged in the cylinder 31. An inner surface of the cylinder is coated with an internal conductive coating 137 contacting with the photocathode 36 and electrically connected to the pin 33. The dynodes 37, 37*a* and the anode 38 are electrically connected to the pins 33.

The dynode 37*a* and the anode 38 are arranged between the ultimate dynode 37 and photocathode 36. The dynode 37*a* is arranged between the anode 38 and photocathode 36. The operation of the photomulitiplier is similar to the photomultiplier shown in FIG. 6 and FIG. 7.

It was confirmed that, according to the present invention, a high mass productivity was obtained, downsizing which was not realized by the conventional technique was achieved, and the manufacturing cost and component cost were largely decreased.

The present invention is not limited to a photomultiplier but can be widely applied to electron tubes having photoelectric surfaces. The material of the cylinder 1 is not particularly limited to Kovar.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron tube, comprising:

a cylinder made of Kovar, having an opening;

a quartz glass plate for receiving light and covering said opening of said cylinder;

a photocathode for converting light passing through said quartz glass plate into electrons, said photocathode coating a surface of said quartz glass plate; and an aluminum seal ring disposed between said cylinder and said quartz glass plate.

2. An electron tube according to claim 1, further comprising:

a stem plate made of borosilicated glass and covering a second opening of said cylinder and being in contact with said cylinder; and a pin penetrating said stem plate and being electrically connected to said photocathode.

3. An electron tube according to claim 2, wherein said cylinder has a portion facing said stem plate, and wherein said portion curves toward an outside of said cylinder.

4. An electron tube according to claim 3, wherein said cylinder has a second portion facing said quartz glass plate, and wherein said second portion curves toward an inside of said cylinder.

5. An electron tube according to claim 1, further comprising:

an anode disposed in said cylinder; and a dynode disposed in said cylinder.

6. An electron tube, comprising:

a cylinder made of Kovar, having an outer surface and an inner surface, said cylinder being curved out at one end and defining a lower opening, said cylinder being curved in at the other end and defining an upper opening;

a stem plate covering said lower opening of said cylinder and attached to said inner surface of said cylinder;

a quartz glass plate for receiving light and covering said upper opening of said cylinder and attached to said outer surface of said cylinder, said quartz glass plate having a diameter smaller than that of said cylinder;

a photocathode for converting light passing through said quartz glass plate into electrons, said photocathode coating a surface of said quartz glass plate; and an aluminum seal ring disposed between said cylinder and said quartz glass plate.

* * * * *